US010074230B2

(12) United States Patent
Blower et al.

(10) Patent No.: US 10,074,230 B2
(45) Date of Patent: Sep. 11, 2018

(54) DISPENSER SHUTTER ASSEMBLY FOR AN AUTOMATED TELLER MACHINE

(71) Applicant: International Business Machines Corporation, Armonk, NY (US)

(72) Inventors: Dave Blower, Middlesex (GB); Simon J. Forsdyke, Loughton (GB); Luke Tombs, Northampton (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/623,868

(22) Filed: Jun. 15, 2017

(65) Prior Publication Data

US 2018/0012436 A1 Jan. 11, 2018

(51) Int. Cl.

| | |
|---|---|
| ***G07F 1/00*** | (2006.01) |
| ***G07D 11/00*** | (2006.01) |
| ***G07F 19/00*** | (2006.01) |
| *G07F 1/02* | (2006.01) |

(52) U.S. Cl.

CPC ..... *G07D 11/0018* (2013.01); *G07D 11/00* (2013.01); *G07F 19/205* (2013.01); *G07F 1/02* (2013.01)

(58) Field of Classification Search

CPC ..... G07D 11/00; G07D 11/0018; G07F 1/02; G07F 7/04; G07F 19/205

See application file for complete search history.

(56) References Cited

U.S. PATENT DOCUMENTS

| | | | | |
|---|---|---|---|---|
| 4,848,873 | A * | 7/1989 | Villar | B61K 9/06 16/319 |
| 6,315,194 | B1 | 11/2001 | Graef et al. | |
| 6,536,662 | B1 | 3/2003 | Ohno | |
| 7,284,692 | B1 | 10/2007 | Douglass | |

(Continued)

FOREIGN PATENT DOCUMENTS

| | | |
|---|---|---|
| CN | 1858811 | 11/2006 |
| CN | 101881840 | 11/2010 |

(Continued)

OTHER PUBLICATIONS

"Motorised Shutter Control—Chapter 12.3" Mar. 2000 28 Pages.*

(Continued)

*Primary Examiner* — Mark J Beauchaine
(74) *Attorney, Agent, or Firm* — Schmeiser, Olsen & Watts, LLP; John Pivnichny

(57) ABSTRACT

A dispenser shutter assembly of an automated teller machine and a method for preventing damage to the dispenser shutter assembly. The dispenser shutter assembly includes: a shutter; a shutter plate; cam followers attached to the shutter plate; a cam coupled to the cam followers; a motor that rotates the cam in a first rotational direction in a plane of rotation of the cam for inducing the cam to act on the cam followers to cause movement of the shutter plate to transition the shutter to a closed state of the shutter; and a cam rotation restrictor positioned so as to prevent rotation of the cam beyond an over center position on the cam's rotational axis by forcing the cam to rotate in a second rotational direction that is opposite the first rotational direction in response to a manual opening of the shutter from the closed state of the shutter.

20 Claims, 8 Drawing Sheets

(56) References Cited

U.S. PATENT DOCUMENTS

| | | | |
|---|---|---|---|
| 7,344,065 | B1 | 3/2008 | Graef |
| 7,523,857 | B1 | 4/2009 | Graef |
| 7,780,083 | B2 | 8/2010 | Schliebe et al. |
| 2005/0173659 | A1 | 8/2005 | Gunnar et al. |
| 2005/0269345 | A1 | 12/2005 | Sommerville |
| 2005/0284925 | A1 | 12/2005 | Ahn et al. |
| 2008/0136657 | A1 | 6/2008 | Clark et al. |
| 2008/0142583 | A1 | 6/2008 | Toshinori et al. |
| 2012/0160860 | A1 | 6/2012 | Milne et al. |
| 2014/0151450 | A1 | 6/2014 | Lewis et al. |
| 2015/0068863 | A1 | 3/2015 | Blower et al. |

FOREIGN PATENT DOCUMENTS

| | | |
|---|---|---|
| CN | 101963031 | 2/2011 |
| CN | 102842014 | 12/2012 |
| DE | 102009003685 | 9/2010 |
| EP | 0965960 | 12/1999 |
| EP | 2648168 | 9/2013 |
| GB | 2414104 | 3/2006 |
| JP | 92006313398 | 11/2006 |

OTHER PUBLICATIONS

Money Pass, The Nation's fastest-growing surcharge-free network, 'Cash claw' fraud on the rise in London, Nov. 29, 2012, Retrieved from internet on Nov. 19, 2013, URL: http://www.atmmarketplace.com/article/204495/-Cash-claw-fraud-on-the-rise-in-London, 3 pages.

Cennox, The ASD-8 Anti-Skimming Device & Trial Proposal, Mar. 7, 2013, www.cennox.com, 7 pages.

Emma Reynolds, Mail Online, Beware the cash trap! Claw-like devices inserted into ATM slots can steal notes in latest hole-in-the-wall scam, Retrieved from internet on Nov. 19, 2013, 6 pages.

International Search Report—PCT (dated Oct. 22, 2014), Applicant's file Reference Gb130082, International Application No. PCT/IB2014/060429, 10 pages.

Office Action (dated Mar. 12, 2015) for U.S. Appl. No. 14/461,768, filed Aug. 18, 2014.

Amendment (dated Jun. 12, 2015) for U.S. Appl. No. 14/461,768, filed Aug. 18, 2014.

Office Action (dated Oct. 18, 2015) for U.S. Appl. No. 14/461,768, filed Aug. 18, 2014.

Amendment (dated Jan. 6, 2016) for U.S. Appl. No. 14/461,768, filed Aug. 18, 2014.

Final Office Action (dated May 4, 2016) for U.S. Appl. No. 14/461,768, filed Aug. 18, 2014.

Final Amendment (dated Jul. 5, 2016) for U.S. Appl. No. 14/461,768, filed Aug. 18, 2014.

Advisory Action (dated Jul. 14, 2016) for U.S. Appl. No. 14/461,768, filed Aug. 18, 2014.

RCE (dated Aug. 4, 2016) for U.S. Appl. No. 14/461,768, filed Aug. 18, 2014.

Office Action (dated Sep. 8, 2016) for U.S. Appl. No. 14/461,768, filed Aug. 18, 2014.

Amendment (dated Dec. 5, 2016) for U.S. Appl. No. 14/461,768, filed Aug. 18, 2014.

Notice of Allowance (dated Jan. 27, 2017) for U.S. Appl. No. 14/461,768, filed Aug. 18, 2014.

U.S. Appl. No. 15/475,333, filed Mar. 31, 2017.

U.S. Appl. No. 15/723,584, filed Oct. 3, 2017.

U.S. Appl. No. 15/723,331, filed Oct. 3, 2017.

RCE (dated Oct. 2, 2017) U.S. Appl. No. 15/475,333, filed Mar. 31, 2017.

Reply to UK examination report, Application No. GB1611909.1, 2 pages, dated Jun. 1, 2017.

Combined Search and Examination Report, Application No. GB1611909.1, dated Jan. 23, 2017, 6 pages.

"Motorised Shutter Control—Chapter 12.3" source and author unknown. See Functional Descdption, 12.3-1 to 12.3-3 iri patiicular. Dated Mar. 2000. URL: http://leoromo.net/docs/cajero/personas/rnotmised%2Oshutter%20contro.pdf, 28 pages.

* cited by examiner

*Figure 1* (PRIOR ART)

*Figure 3* (PRIOR ART)

*Figure 6* (PRIOR ART)
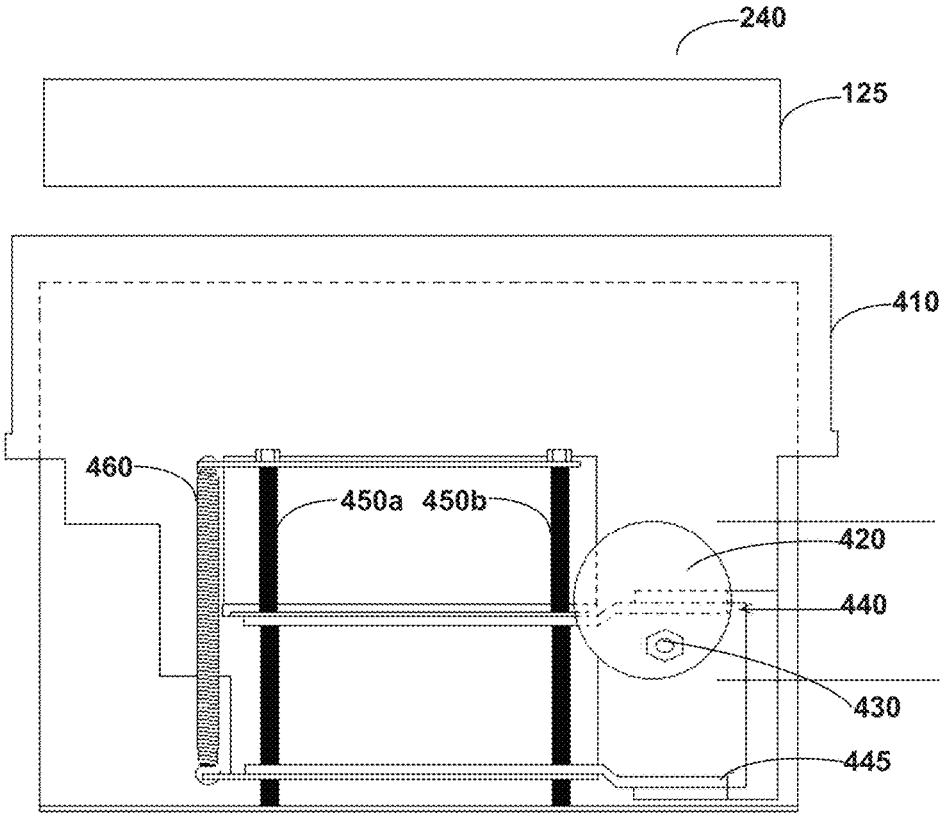
*Figure 7* (PRIOR ART)
Side View Section
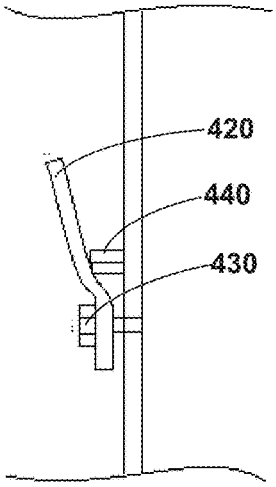

DISPENSER SHUTTER ASSEMBLY FOR AN AUTOMATED TELLER MACHINE

TECHNICAL FIELD

The present invention relates to automated teller machines, and in particular relates to a dispenser shutter assembly for an automated teller machine that includes a mechanism to prevent damage to the dispenser shutter assembly during manual opening of the shutter of the dispenser shutter assembly.

BACKGROUND

Automated banking machines are well known. A common type of automated banking machine used by consumers is an automated teller machine ("ATM"), colloquially known by terms such as "cash dispenser", "cash machine" or "hole-in-the-wall". ATMs enable customers to carry out banking transactions. Common banking transactions that may be carried out with ATMs include the dispensing of cash in the form of paper currency, the receipt of deposits, the transfer of funds between accounts, the payment of bills, account balance inquiries and mobile phone top-up, etc. The types of banking transactions a customer can carry out are determined by capabilities of the particular banking machine and the institution offering the service.

In the United Kingdom there are around seventy thousand ATMs and this number is on the increase. ATM fraud is also on the increase and perpetrators are constantly devising new ways in which to fraudulently extract cash from inside ATMs. One method in which perpetrators attempt to extract cash from an ATM is by using a cash capture device. A cash capture device is inserted by the perpetrator into a cash dispensing slot such that the cash is intercepted by the cash capture device inside the ATM and not dispensed to a user who has requested the cash. The perpetrator then returns to the ATM to remove the cash that is retained inside the ATM. During the removal operation, the perpetrator forces open the shutter of the ATM from the closed position. In some designs of ATM, the forcing open of the shutter damages the shutter operating mechanism so that the ATM is disabled which requires intervention by a service engineer before the ATM can return to service.

SUMMARY

Embodiments of the present invention provide a dispenser shutter assembly of an automated teller machine and a method for preventing damage to the dispenser shutter assembly during a manual opening of a shutter.

The dispenser shutter assembly comprises: the shutter; a shutter plate; a pair of cam followers attached to the shutter plate; a cam coupled to the cam followers; a motor configured to rotate the cam in a first rotational direction in a plane of rotation of the cam for inducing the cam to act on the cam followers to cause movement of the shutter plate in a first linear direction to transition the shutter from an open state of the shutter to a closed state of the shutter; and a cam rotation restrictor positioned so as to prevent rotation of the cam beyond an over center position on the cam's rotational axis during said movement of the shutter plate in the first linear direction to transition the shutter to the closed state of the shutter, so that a subsequent manual operating of the shutter plate to open the shutter forces rotation of the cam in a second rotational direction which is opposite the first rotational direction.

The method for preventing damage to the dispenser shutter assembly of an automated teller machine during a manual opening of a shutter comprises; (i) the motor rotating the cam in the first rotational direction in the plane of rotation of the cam which induces the cam to act on the cam followers to cause movement of the shutter plate in the first linear direction to transition the shutter from the open state of the shutter to the closed state of the shutter; and (ii) in response to the manual opening of the shutter from the closed state of the shutter, forcing the cam to rotate in the second rotational direction, said forcing being caused by preventing, by the cam rotation restrictor, the cam from rotating beyond the over center position on the cam's rotational axis.

BRIEF DESCRIPTION OF THE DRAWINGS

The present invention will now be described by way of example only, with reference to the accompanying drawings.

FIG. 6 is a rear view of a shutter assembly of the known automated teller machine showing the shutter after the shutter has been forced open from a closed position.

FIG. 7 is a side view of a part of the shutter assembly of the known automated teller machine illustrated in FIG. 6, showing the damage caused by the forced opening of the shutter;

DETAILED DESCRIPTION

The present invention prevents the disabling of the automated teller machine (ATM) by the shutter forcing operation, so that fraudulent activity that opens the shutter of the ATM does not result in an unserviceable ATM.

Figure 1:
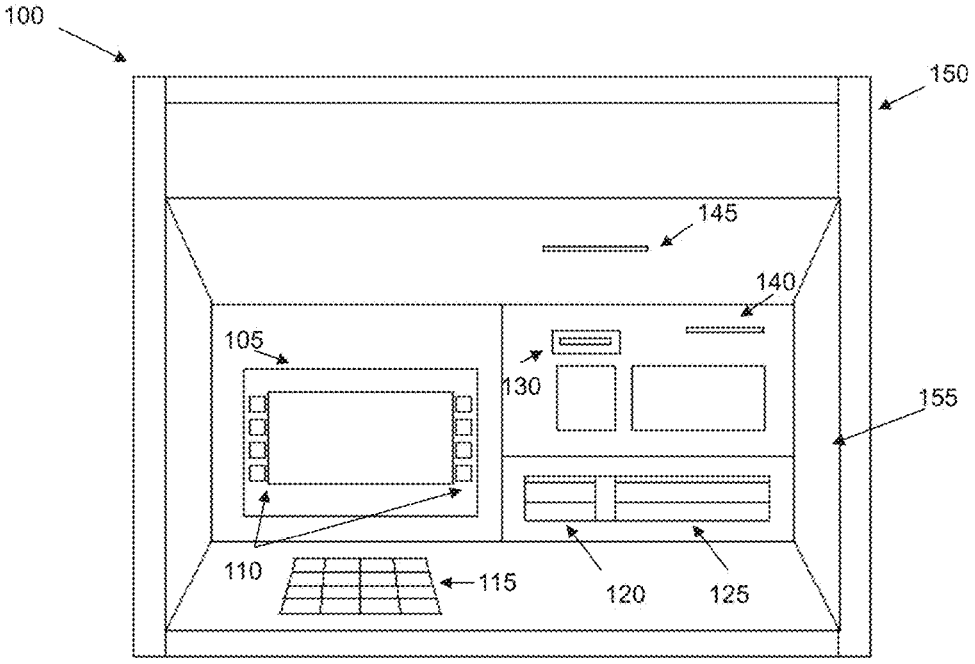
FIG. 1 is an illustration of an outer public face of an automated teller machine (ATM) as is known in the art.
Figure 2:
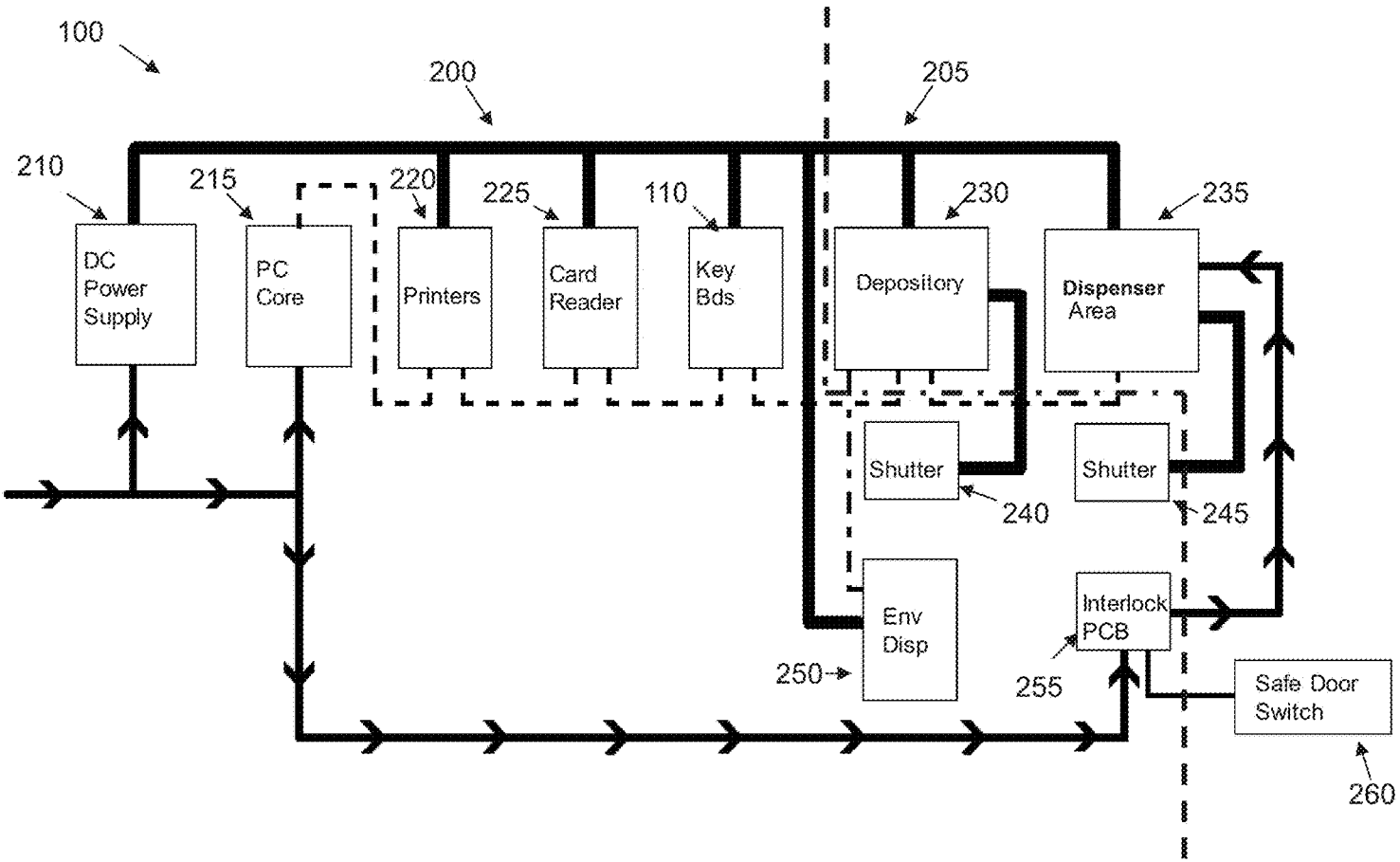
Figure 2 (PRIOR ART)
FIG. 2 is a block diagram illustrating an example of the internal components of the automated teller machine of FIG. 1 as is known in the art.

FIG. 1 is an illustration of an outer public face of an automated teller machine (ATM) 100 as is known in the art and FIG. 2 is a block diagram illustrating an example of the internal components of the automated teller machine 100 of FIG. 1 as is known in the art. FIG. 1 and FIG. 2 should be read in conjunction with each other.

The ATM 100 comprises a housing 150 which comprises a non-secure portion 200 and a secure portion 205.

The non-secure portion 200 comprises a further housing having a public outer fascia 155 which comprises a display 105 for displaying user information to a user, screen selection keys 110 and keypad 115 for inputting data, a DC power supply 210, a card reader 225 for receiving a user bank card or other form of identity via a card receiving aperture 130, a cash dispensing aperture 125 and associated shutter assembly 245 for dispensing cash in the form of paper currency processed and stored in a dispenser area 235 of the ATM 100, a deposit aperture 120 for receiving deposits stored in a depository 230 and communicating with a deposit shutter assembly 240, an envelope dispensing aperture 145 for dispensing from envelope dispenser 250 envelopes for holding cash or check deposits for receiving by the deposit aperture 120, a receipt dispensing aperture 140 for dispensing receipts acknowledging a transaction made by a customer, an interlock PCB 255 coupled to a safe door switch 260, and a printer 220 for printing the receipts.

The non-secure portion 200 also houses a data processing apparatus 215 (which may include a PC core) for communicating with each of the components of the ATM 100 in order to process a requested transaction and to control the mechanical components of the ATM 100 in order to complete a requested and authorized transaction.

Figure 3:
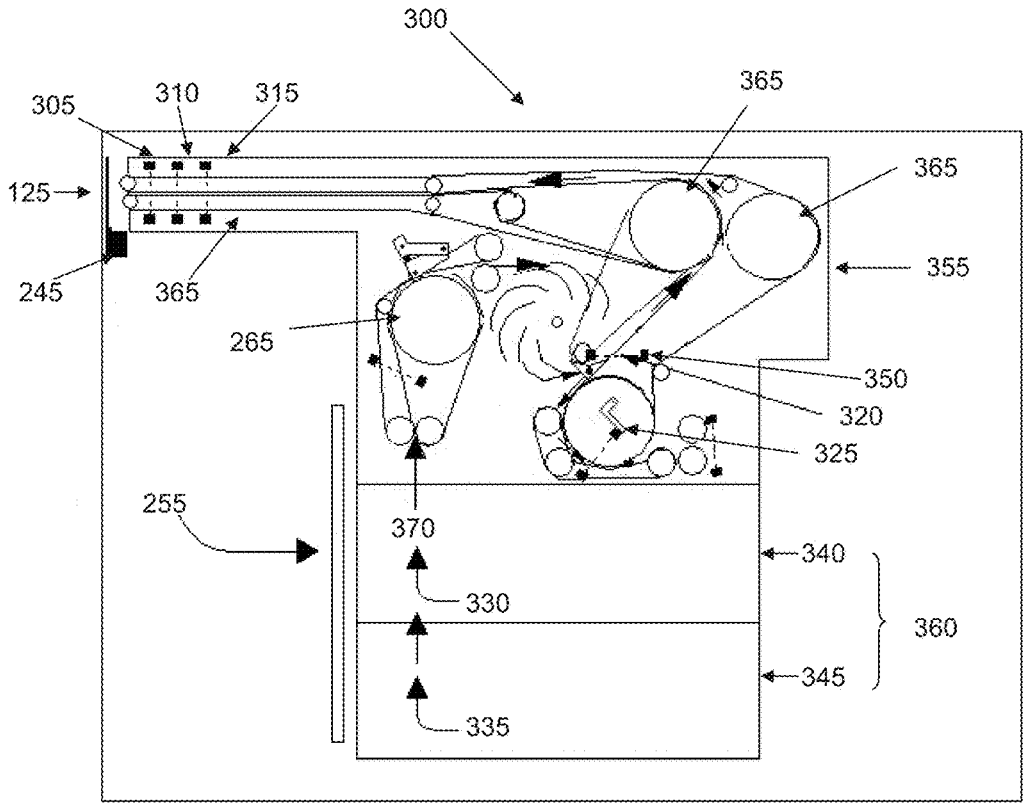
FIG. 3 is a schematic diagram illustrating a side view cross section of an example of an automated teller machine cash dispenser as is known in the art.

FIG. 3 is a schematic diagram illustrating a side view cross section of an example of an automated teller machine cash dispenser as is known in the art. FIG. 3 illustrates the secure portion 205 of FIG. 2 in further detail. The secure portion comprises a safe 300. The safe 300 comprises a housing having a first portion comprising a number of slideably mountable racks for mounting currency cassettes 340, 345 (collectively, 360) for storing paper currency. Paper currency is intended herein to mean UK banknotes, U.S.A dollar bills etc. The actual material of the banknotes may be other than paper, for example a polymer material. A second portion of the housing comprises one or more slideably mountable racks for mounting a presenter unit 355 comprising pick up modules 265 for singly picking-up one or more paper currency until the requested paper currency denomination is reached. The presenter unit 355 also comprises presenter belts 365 for transporting the requested paper currency from the currency cassettes 340, 345 along a transportation path 330, 335, 370 to the dispenser aperture 125. The second portion further comprises a slideably mountable reject tray (not shown) for holding reject paper currency detected by the data processing apparatus 215. The presenter unit 355 also comprises timing disk sensor arm 325 and drive belt 320.

Dispenser area 235 further comprises a number of optical sensors 305, 310, 315 for detecting and validating the presence of paper currency in the presenter area 235.

For clarity, the dispenser area 235 referred to herein comprises the presenter unit 355, the dispenser shutter assembly 245 and cash dispenser aperture 125. A person skilled in the art will realize that there are many types of internal configurations of an ATM 100 and the above description is not limiting. Many other configurations are possible without departing from the scope of the present invention.

In use a user inserts the user's bank card into the card reader 130 and the display unit 105 requests the user to enter the user's personal identification number. The data processing apparatus 215 validates the personal identification number and the display unit 105 presents the user with a number of financial transaction options. When a request for cash withdrawal is made and approved, the data processing apparatus 215 sends an instruction to the pickup module 265 which causes the pickup module 265 to obtain the requested paper currency from one or more of the currency cassettes 340, 345. As the individual units of paper currency are requested, the units of paper currency are validated and in response, the presenter belts 365 transport the paper currency through the secure housing along a transportation path 330, 335 (following the direction of the arrows) for dispensing to the user through the cash dispenser aperture 125. In one embodiment, when the paper currency is transported along the transportation path, the paper currency passes under various sensors 350, 315, 310 and 305. The sensors perform various functions such as the following functions.

Sensor 350 acknowledges presence of paper currency after the measuring process.

Sensor 315 acknowledges timely arrival of paper currency for dispense.

Sensor 310 acknowledges timing restrictions and initiates a signal for the dispenser shutter to open.

Sensor 305 acknowledges a timing sequence and signals for dispenser shutter to close.

Once the paper currency is transported a predetermined distance from sensor 305, the cash dispenser shutter 245 remains open until the user removes the paper currency from the cash dispenser aperture 125. Once the paper currency is removed by the user, the cash dispenser shutter 245 closes.

Figure 4:
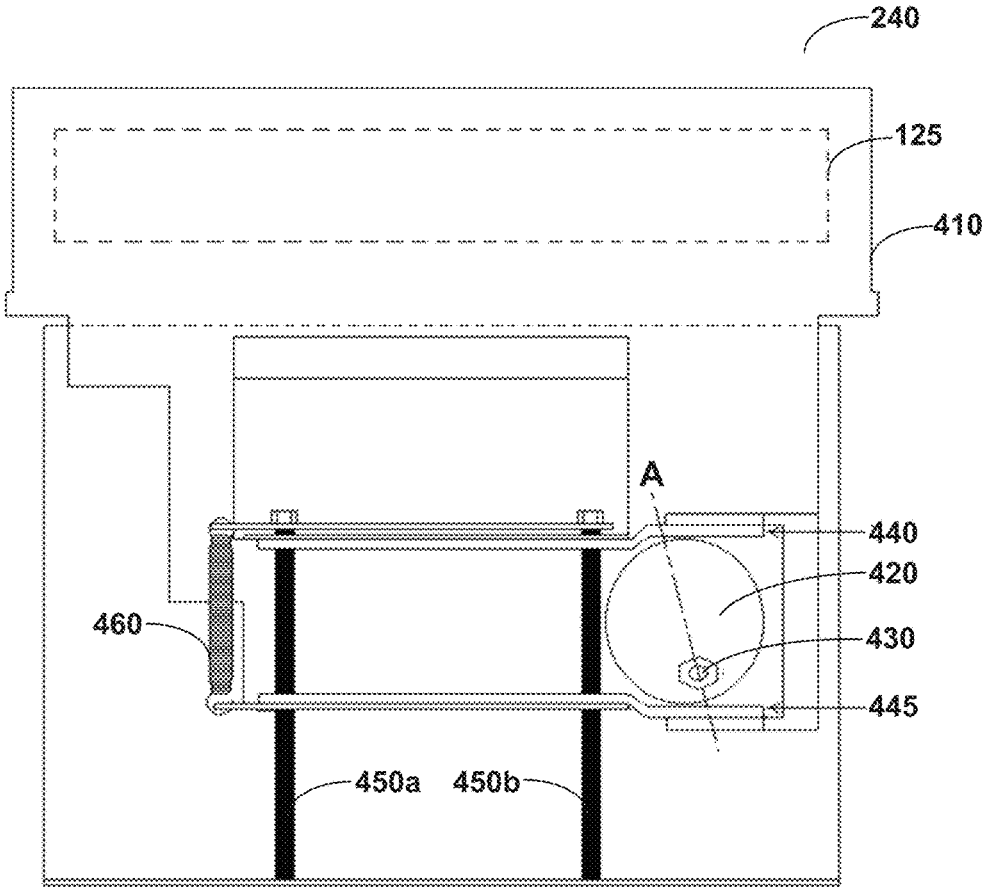
Figure 4 (PRIOR ART)
FIGS. 4 and 5 depict a rear view of a shutter assembly of a known automated teller machine showing the shutter in the closed position and in the open position, respectively.
Figure 5:
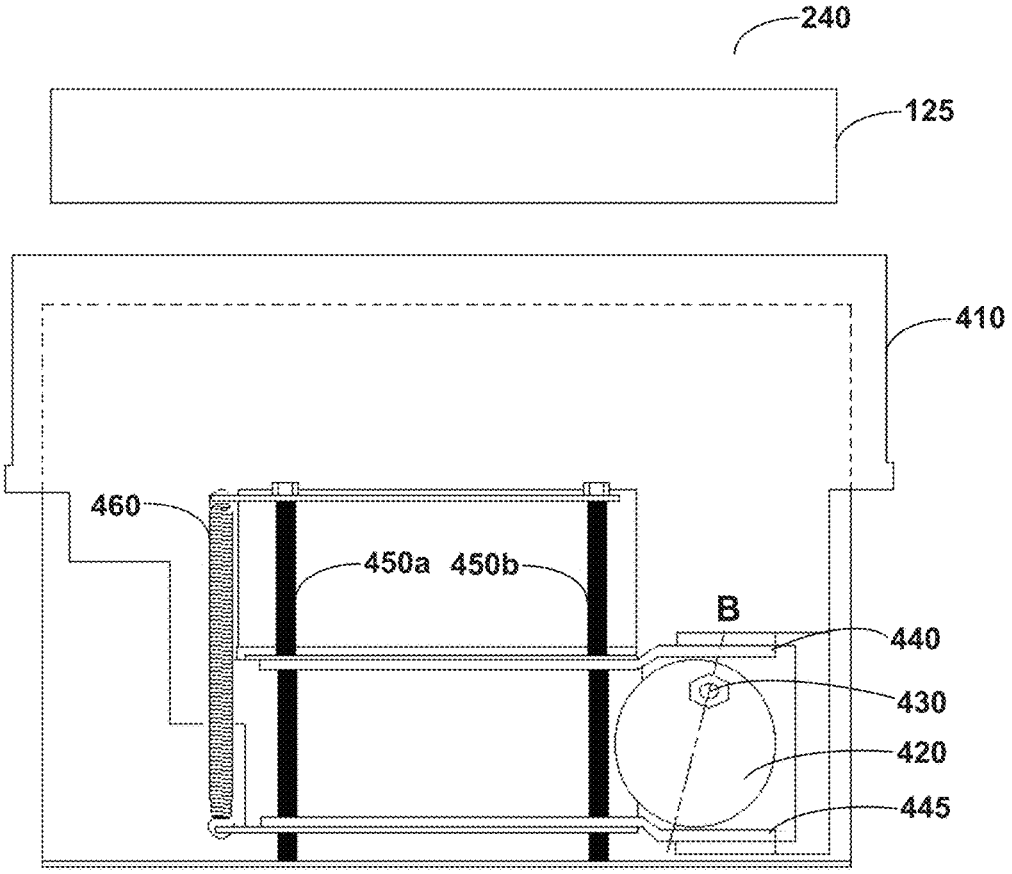
Figure 5 (PRIOR ART)

FIGS. 4 and 5 depict a front plan view of a shutter assembly 240 of a known automated teller machine showing the shutter in the closed position and in the open position, respectively. The skilled person will understand that other types of ATM are available and the ATM may be an ATM of a different type.

FIG. 4 illustrates the assembly 240 with the shutter in the closed state. Shutter plate 410 covers cash dispensing aperture 125 in the closed state. Attached to shutter plate 410 are cam followers 440 and 445. Cam 420 is operable for rotation in the space defined by cam followers 440 and 445. Cam 420 is attached to and operable for rotation by pivot shaft 430. Pivot shaft 430 is rotatable by attached shutter assembly motor (not shown). Cam 420 may have a flattened disc shape with pivot shaft 430 attached non-centrally so as to produce a camming action when rotated between cam followers 440 and 445. Further provided are guides 450*a* and 450*b*. Shutter plate 410 and attached cam followers 440 and 445 are operable for moving along guides 450*a* and 450*b*. Guides 450*a* and 450*b* may comprise, for example, elongate cylindrical members which pass through matching holes in flange attachments of shutter plate 410 and are fixedly attached to the body of shutter assembly 245. Also present may be spring 460 attached at one end to the moveable shutter plate 410 and at the other to the body of shutter assembly 245.

FIG. 5 illustrates a rear view of shutter assembly 240 of FIG. 4 with the shutter in the open state. Shutter plate 410 is retracted so as to not cover any of cash dispensing aperture 125 in the open state.

Normal operation of shutter assembly 245 will be described with reference to FIGS. 4 and 5. When the shutter is in the closed state of FIG. 4, ATM control circuitry issues a shutter open command. In response, the shutter assembly motor operates to rotate pivot shaft 430 in a clockwise direction as viewed from FIG. 4. Cam 420 rotates and acts on cam follower 445 to move shutter plate 410 in a downward direction in order to open the shutter as viewed in FIG. 4, moving along guides 450*a* and 450*b*. The shutter assembly motor ceases rotating pivot shaft 430 in the clockwise direction when shutter plate 410 reaches the shutter open state of FIG. 5 at which point cash dispensing aperture 125 is fully exposed. During the opening operation, spring 460 extends from an idle position in FIG. 4 to an extended position under tension in FIG. 5.

When ATM control circuitry issues a shutter close command, in response the shutter assembly motor rotates pivot shaft 430 in an anti-clockwise (i.e., counterclockwise) direction. Cam 420 acts on cam follower 440 to move shutter plate 410 in an upward direction in order to close the shutter as viewed in FIG. 5. The shutter assembly motor ceases rotating pivot shaft 430 in the anti-clockwise direction when shutter plate 410 reaches the position as shown in FIG. 4. Spring 460 relaxes during this operation until spring 460 is in an idle state. Cash dispensing aperture 125 is now fully covered by shutter plate 410 and in the closed state.

In various embodiments, with normal operation of shutter assembly 245, operation of the shutter assembly motor is configured to rotate pivot shaft 430 and cam 420 in a first rotational direction for inducing the cam 420 to act on the cam follower 440, 445 to move shutter plate 410 in a first linear direction to transition the shutter from an open state to a closed state, and is further configured to rotate pivot shaft 430 and cam 420 in a second rotational direction for inducing the cam 420 to act on the cam follower 440, 445 to move shutter plate 410 in a second linear direction to transition the shutter from the closed state to the open state, wherein the first and second linear directions are opposite each other, wherein the first and second rotational directions are opposite each other, and wherein the first and second linear directions are in a plane in which the cam 420 is configured to rotate in the first and second rotational directions. Each rotational direction of the first and second rotational directions is a clockwise direction or an anti-clockwise direction.

It will be apparent to the skilled person that when cam 420 moves to position A of FIG. 4 the cam 420 has moved over center position on the rotational axis of the cam 420 and beyond the point of maximum camming action. The over center position is that at which maximum effect of the camming action of cam 420 is reached. When the shutter assembly motor ceases rotation at the position A of FIG. 4, there is a locking effect on shutter plate 410. Any external action to manually move shutter plate 410 to attempt to open the shutter and expose cash dispensing aperture 125 will tend to force cam 420 into further anti-clockwise rotation rather than reversing cam 420 for clockwise rotation. An over center position on the rotational axis of the cam 420 is also reached by cam 420 at the fully open position of FIG. 5 when the cam is in position B.

When an attempt is made to open the closed shutter of FIG. 4, for example by the inserting of an elongate metal object and applying levering action, the mechanism may respond as shown in FIGS. 6 and 7.

FIG. 6 is a rear view of a shutter assembly of the known automated teller machine showing the shutter after the shutter has been forced open from a closed position, and FIG. 7 is a side view of a part of the shutter assembly of the known automated teller machine illustrated in FIG. 6, showing the damage caused by the forced opening of the shutter.

Further anti-clockwise motion of cam 420 is restricted by cam followers 440 and 445. Manual forcing of shutter plate 410 to an open position, downwards as viewed in FIG. 6, results in cam 420 attempting to rotate further in an anti-clockwise direction, which is impossible and accordingly, cam 420 distorts and rides over cam follower 440 so as to produce the abnormal shutter open state of FIG. 6. FIG. 7 is a side view of part of FIG. 6. Cam follower 440 has been forced under cam 420, distorting cam 420 and rendering cam 420 inoperable. Shutter assembly 245 is now jammed in a shutter open state and the ATM is unserviceable and requires repair by an engineer.

Figure 8:
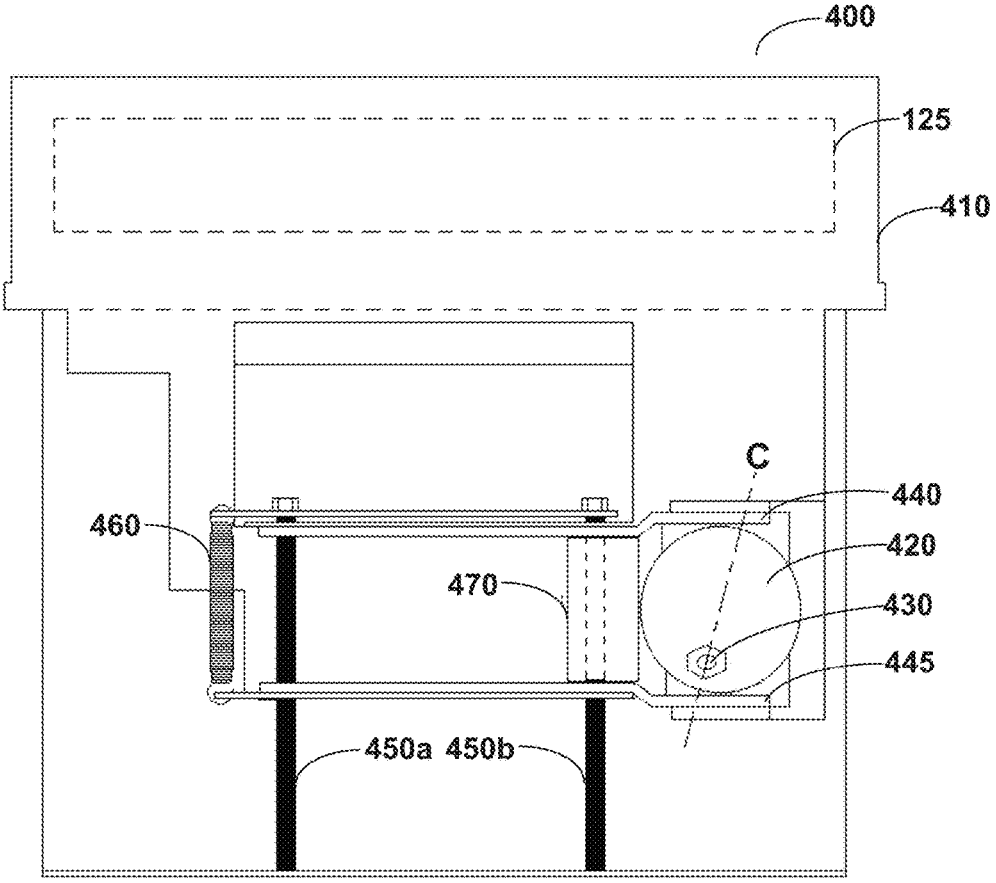
FIGS. 8 and 9 depict a rear view of an embodiment of the present invention showing the shutter in the closed position and in the open position, respectively.
Figure 9:
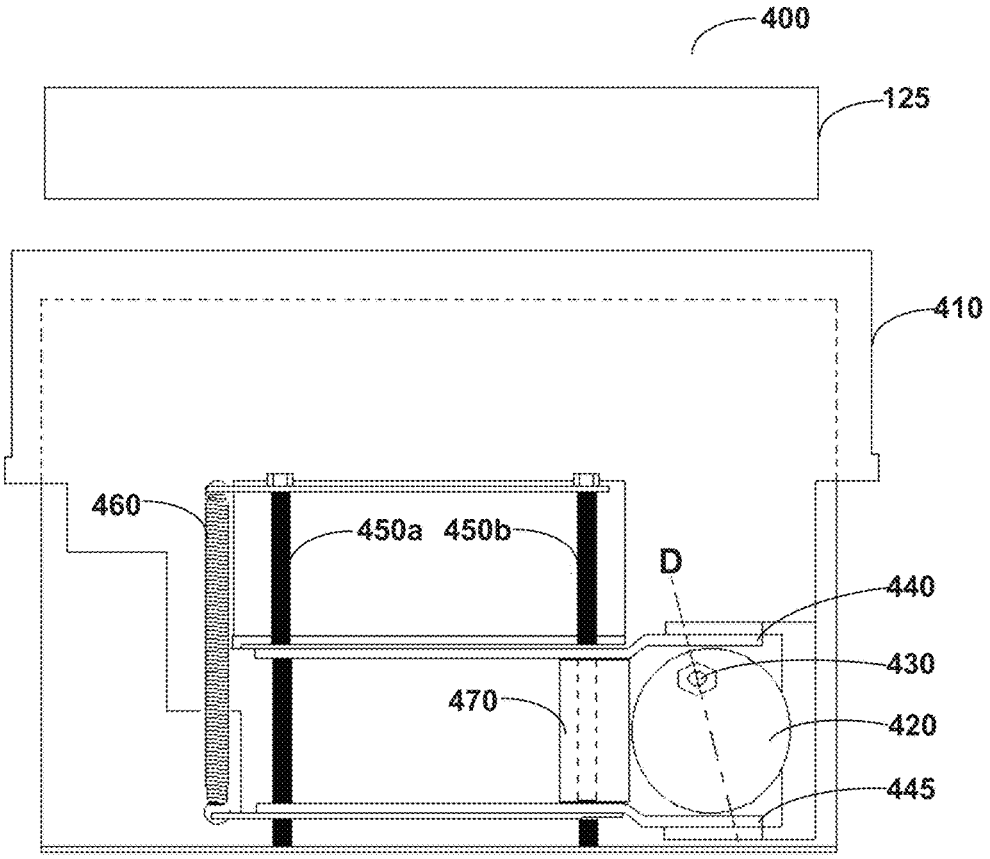

FIGS. 8 and 9 depict a rear view of an embodiment of the present invention showing the shutter in the closed position and in the open position, respectively.

Shutter assembly 400 comprises similar elements to those described above with reference to the known ATM shutter assembly of FIGS. 4 and 5. The shutter assembly of the embodiment differs from the known shutter assembly in that cam 420 cannot rotate beyond an over center position on the rotational axis of the cam 420 at the closed position of the shutter.

Shutter assembly 400 comprises cam 420 mounted on pivot shaft 430 and rotatable between cam followers 440 and 445. Shutter assembly 400 further comprises a cam rotation restrictor, or stop block 470. Cam rotation restrictor, for example stop block 470, is positioned in the plane of rotation of cam 420 as shown in FIGS. 8 and 9 so as to prevent rotation of cam 420 beyond the over center position of the camming action. Starting from the shutter open position of FIG. 9, the shutter assembly motor rotates pivot shaft anti-clockwise until the shutter assembly is in the shutter closed state of FIG. 8. When cam 420 reaches position C of FIG. 8, further rotation is prevented. Position C is before the over center point of the camming action of cam 420, and there is no locking effect as described above with reference to the known ATM shutter assembly of FIGS. 4 and 5. Likewise, position D of FIG. 9 is also before an over center position is reached so that there is no locking effect at the shutter open position. Cam travel is restricted at both limits of the rotation of the cam 420.

In one embodiment, if the cam rotation restrictor 470 is a stop block, the stop block is made of wood (e.g., oak). In other embodiments, the stop block may be made of plastic, rubber, or metal.

Cam rotation restrictor 470 is a device which physically restricts rotation of cam 420 at the extremities of the rotational travel of cam 420. In an embodiment, cam rotation restrictor 470 comprises a stop block as illustrated in FIGS. 8 and 9. Cam rotation restrictor 470 may comprise a stop block which fits over guide 450*b*, and is aligned with guide 450*b* in the direction of orientation of the guide 450*b*, so as to substantially fill the space between cam followers 440 and 445 in the plane of rotation of cam 420. In the embodiment of FIG. 8, cam rotation restrictor 470, which may be a stop block, is positioned between, and in direct physical contact with, cam followers 440 and 445. In one embodiment, cam rotation restrictor 470 is sized so as to abut against cam 420 so as to be in direct physical contact with cam 420, and so restrict travel of cam 420, at both extremes of the camming rotation of cam 420, so that cam travel of cam 420 is stopped before an over center position of camming action. Cam 420 is physically unable to pass beyond an over center position of camming action.

If a manual opening is attempted of the shutter of shutter assembly 400 when in the shutter closed position of FIG. 8, cam follower 440 will be forced against cam 420. Because cam 420 has not rotated beyond the over center position of the camming action because of cam rotation restrictor 470, cam 420 is forced back by cam follower 440 to rotate in a clockwise direction on pivot shaft 430, which is an abnormal rotation that is restricted only by the drive mechanism of the shutter assembly motor which is designed to be overridden when force is applied. No lasting damage is done to the cam or to the shutter assembly motor.

It should be noted that the described embodiment does not prevent fraudulent accessing of the cash dispensing aperture. However, the ATM is not left in an unserviceable state by the fraudulent activity and is able to perform any recovery actions and return to an operational state without need for repair by an engineer. This increases ATM availability and reduces maintenance costs.

As may be seen from the embodiment of FIGS. 8 and 9, the height of the cam rotation restrictor 470 (in the direction of motion of shutter plate 410) is less than the length of the spring 460 (in the direction of motion of shutter plate 410)

regardless of whether the shutter is in the closed position (FIG. 8) or in the open position (FIG. 9).

As may be seen from the embodiment of FIGS. 8 and 9, cam 430 is circular with a diameter that exceeds the height of the cam rotation restrictor 470.

It will be apparent to the skilled person that other components may need to be changed when compared with the known ATM shutter assembly as described with reference to FIGS. 4 and 5 because of the restricted cam travel of the embodiment. For example, spring 460 may need to be shorter in the shutter assembly of the embodiment as compared with the known shutter assembly. Sensors and other settings may also need to be changed.

It will further be apparent to the skilled person that other modification may be made to the above without departing from the scope of the invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

What is claimed is:

1. A dispenser shutter assembly of an automated teller machine, said dispenser shutter assembly comprising:

a shutter;

a shutter plate;

a pair of cam followers attached to the shutter plate;

a cam coupled to the cam followers;

a motor configured to rotate the cam in a first rotational direction in a plane of rotation of the cam for inducing the cam to act on the cam followers to cause movement of the shutter plate in a first linear direction to transition the shutter from an open state of the shutter to a closed state of the shutter; and a cam rotation restrictor positioned so as to prevent rotation of the cam beyond an over center position on the cam's rotational axis during said movement of the shutter plate in the first linear direction to transition the shutter to the closed state of the shutter, so that a subsequent manual operating of the shutter plate to open the shutter forces rotation of the cam in a second rotational direction which is opposite the first rotational direction.

2. The dispenser shutter assembly of claim 1, wherein the cam rotation restrictor is a stop block positioned in the plane of rotation of the cam.

3. The dispenser shutter assembly of claim 1, wherein the cam rotation restrictor is positioned between, and in direct physical contact with, the cam followers.

4. The dispenser shutter assembly of claim 1, wherein the cam rotation restrictor abuts against the cam so as to prevent the rotation of the cam beyond the cam's over center position on the cam's rotational axis.

5. The dispenser shutter assembly of claim 1, wherein the cam is circular with a diameter that exceeds a height of the cam rotation restrictor in the first linear direction.

6. The dispenser shutter assembly of claim 1, said dispenser shutter assembly further comprising a pair of guides, wherein each guide is oriented in the first linear direction, wherein action of the cam on the cam followers causes the cam followers to move along the guide in the first direction, and wherein the cam rotation restrictor fits over a first guide of the pair of guides and is aligned with the first guide in the first linear direction.

7. The dispenser shutter assembly of claim 1, said dispenser shutter assembly further comprising a spring oriented in the first linear direction, wherein the length of the spring in the first linear direction is configured to shorten or elongate in the first linear direction as the shutter plate moves in the first linear or in a second linear direction, respectively, wherein the first and second linear directions are opposite each other and are in the plane of rotation of the cam, and wherein a height of the cam rotation restrictor in the first linear direction is less than the shortest length of the spring in the first linear direction.

8. The dispenser shutter assembly of claim 1, wherein the cam's rotational axis is displaced from a geometric center of the cam.

9. The dispenser shutter assembly of claim 1, wherein the motor is further configured to rotate the cam in a second rotational direction for inducing the cam to act on the cam follower to cause movement of the shutter plate in a second linear direction to transition the shutter from the closed state of the shutter to the open state of the shutter, and wherein the first and second linear directions are opposite each other and are in the plane of rotation of the cam.

10. A method for preventing damage to a dispenser shutter assembly of an automated teller machine during a manual opening of a shutter, said dispenser shutter assembly comprising:

the shutter;

a shutter plate;

a pair of cam followers attached to the shutter plate;

a cam coupled to the cam followers;

a motor configured to rotate the cam in a first rotational direction in a plane of rotation of the cam for inducing the cam to act on the cam followers to cause movement of the shutter plate in a first linear direction to transition the shutter from an open state of the shutter to a closed state of the shutter; and a cam rotation restrictor positioned so as to prevent rotation of the cam beyond an over center position on the cam's rotational axis during said movement of the shutter plate in the first linear direction to transition the shutter to the closed state of the shutter, so that a subsequent manual operating of the shutter plate to open the shutter forces rotation of the cam in a second rotational direction which is opposite the first rotational direction, said method comprising:

the motor rotating the cam in the first rotational direction in the plane of rotation of the cam which induces the cam to act on the cam followers to cause movement of the shutter plate in the first linear direction to transition the shutter from the open state of the shutter to the closed state of the shutter; and in response to the manual opening of the shutter from the closed state of the shutter, forcing the cam to rotate in the second rotational direction, said forcing being caused by preventing, by the cam rotation restrictor, the cam from rotating beyond the over center position on the cam's rotational axis.

11. The method of claim 10, wherein said preventing the cam from rotating beyond the over center position on the cam's rotational axis prevents damage to the automated teller machine from said manual opening of the shutter from the closed state of the shutter.

12. The method of claim 10, wherein the manual opening of the shutter comprises a fraudulent access of the automated teller machine.

13. The method of claim 10, wherein the cam rotation restrictor is a stop block positioned in the plane of rotation of the cam.

14. The method of claim 10, wherein the cam rotation restrictor is positioned between, and in direct physical contact with, the cam followers.

15. The method of claim 10, wherein the cam rotation restrictor abuts against the cam so as to prevent the rotation of the cam beyond the cam's over center position on the cam's rotational axis.

16. The method of claim 10, wherein the cam is circular with a diameter that exceeds a height of the cam rotation restrictor in the first linear direction.

17. The method of claim 10, said dispenser shutter assembly further comprising a pair of guides, wherein each guide is oriented in the first linear direction, wherein action of the cam on the cam followers causes the cam followers to move along the guide in the first direction, and wherein the cam rotation restrictor fits over a first guide of the pair of guides and is aligned with the first guide in the first linear direction.

18. The method of claim 10, said dispenser shutter assembly further comprising a spring oriented in the first linear direction, wherein the length of the spring in the first linear direction is configured to shorten or elongate in the first linear direction as the shutter plate moves in the first linear or in a second linear direction, respectively, wherein the first and second linear directions are opposite each other and are in the plane of rotation of the cam, and wherein a height of the cam rotation restrictor in the first linear direction is less than the shortest length of the spring in the first linear direction.

19. An automated teller machine, comprising a dispenser shutter assembly, said dispenser shutter assembly comprising:

a shutter;

a shutter plate;

a pair of cam followers attached to the shutter plate;

a cam coupled to the cam followers;

a motor configured to rotate the cam in a first rotational direction in a plane of rotation of the cam for inducing the cam to act on the cam followers to cause movement of the shutter plate in a first linear direction to transition the shutter from an open state of the shutter to a closed state of the shutter; and a cam rotation restrictor positioned so as to prevent rotation of the cam beyond an over center position on the cam's rotational axis during said movement of the shutter plate in the first linear direction to transition the shutter to the closed state of the shutter, so that a subsequent manual operating of the shutter plate to open the shutter forces rotation of the cam in a second rotational direction which is opposite the first rotational direction.

20. The automated teller machine of claim 19, wherein the cam rotation restrictor is a stop block positioned in the plane of rotation of the cam.

* * * * *